US005622223A

United States Patent [19]

Vasquez

[11] Patent Number: 5,622,223

[45] Date of Patent: Apr. 22, 1997

[54] APPARATUS AND METHOD FOR RETRIEVING FORMATION FLUID SAMPLES UTILIZING DIFFERENTIAL PRESSURE MEASUREMENTS

[75] Inventor: Rafael B. Vasquez, Katy, Tex.

[73] Assignee: Haliburton Company, Houston, Tex.

[21] Appl. No.: 522,851

[22] Filed: Sep. 1, 1995

[51] Int. Cl.[6] ..... E21B 49/00; E21B 47/00

[52] U.S. Cl. ..... 166/264; 166/100

[58] Field of Search ..... 166/100, 264, 166/250.02, 321, 374, 66.4, 72; 73/151, 155

[56] References Cited

U.S. PATENT DOCUMENTS

| | | | |
|---|---|---|---|
| 2,681,110 | 6/1954 | Harrison | 166/55 |
| 2,776,013 | 1/1957 | Tausch | 166/150 |
| 2,982,130 | 5/1961 | McMahan | 73/155 |
| 3,009,518 | 11/1961 | Taylor et al. | 166/100 |
| 3,010,517 | 11/1961 | Lanmon, II | 166/100 |
| 3,011,554 | 12/1961 | Desbrandes et al. | 166/100 |
| 3,012,611 | 12/1961 | Haines | 166/147 |
| 3,022,826 | 2/1962 | Kisling, III | 166/100 |
| 3,035,440 | 4/1962 | Reed | 73/151 |
| 3,055,764 | 9/1962 | Pryor et al. | 166/109 |
| 3,075,585 | 1/1963 | Carlton et al. | 166/164 |
| 3,079,793 | 3/1963 | Le Bus et al. | 73/152 |
| 3,121,459 | 2/1964 | Van Ness, Jr. et al. | 166/3 |
| 3,127,933 | 4/1964 | Graham et al. | 166/3 |
| 3,134,441 | 5/1964 | Barry et al. | 166/187 |
| 3,177,938 | 4/1965 | Roussin | 166/4 |
| 3,190,360 | 6/1965 | Farley | 166/226 |
| 3,207,223 | 9/1965 | Hugel | 166/163 |
| 3,209,835 | 10/1965 | Bourne, Jr. et al. | 166/187 |
| 3,217,804 | 11/1965 | Peter | 166/63 |
| 3,217,806 | 11/1965 | Voetter | 166/163 |
| 3,248,938 | 5/1966 | Hill et al. | 73/155 |
| 3,253,654 | 5/1966 | Briggs, Jr. et al. | 166/100 |
| 3,254,531 | 6/1966 | Briggs, Jr. | 73/155 |
| 3,254,710 | 6/1966 | Jensen | 166/3 |
| 3,261,402 | 7/1966 | Whitten | 166/63 |
| 3,273,647 | 9/1966 | Briggs, Jr. et al. | 166/100 |
| 3,280,917 | 10/1966 | Kisling, III | 166/150 |
| 3,285,344 | 11/1966 | Jensen | 166/149 |

(List continued on next page.)

FOREIGN PATENT DOCUMENTS

| | | | |
|---|---|---|---|
| 2172630 | 9/1986 | United Kingdom | E21B 49/08 |
| 2172631 | 9/1986 | United Kingdom | E21B 49/08 |

OTHER PUBLICATIONS

M.C. Waid, M.A. Proett, C.C. Chen, & W.T. Ford, Improved Models for Interpreting the Pressure Response of Formation Testers, Society of Petroleum Engineers, Dallas, Texas, Oct. 6–9, 1991, pp. 889–904.

*Primary Examiner*—Frank Tsay
*Attorney, Agent, or Firm*—Madan & Morris

[57] ABSTRACT

This invention provides a closed-loop system for in situ testing of formation fluid conditions and for selectively collecting substantially mud filtrate free formation fluid samples at original formation conditions. The system contains an elongated member having a probe that is sealingly placed against the wellbore formation to withdraw formation fluids. A surface controlled pump controls the flow of a fluid from the formation into a flow line placed in the elongated member. A pressure sensor provides downhole hydrostatic pressure and differential pressure sensor provides difference in pressure across two fixed points across the flow line. A temperature sensor and resistivity device are utilized in a conventional manner to respectively provide downhole fluid temperature and the resistivity of the formation fluid. The system determines the density of the formation fluid in the flow line from the differential pressure and in response thereto controls the fluid flow into the flow line to selectively collect the formation fluid samples that are substantially free from any mud filtrates while maintaining the fluid pressure above the bubble point pressure of the fluid. This invention provides a method for retrieving and collecting formation fluids from a zone of interest in a wellbore at the original formation conditions.

20 Claims, 2 Drawing Sheets

U.S. PATENT DOCUMENTS

| | | | |
|---|---|---|---|
| 3,291,219 | 12/1966 | Nutter | 166/145 |
| 3,305,014 | 2/1967 | Brieger | 166/3 |
| 3,305,023 | 2/1967 | Farley | 166/226 |
| 3,306,102 | 2/1967 | Lebourg | 73/155 |
| 3,308,882 | 3/1967 | Lebourg | 166/3 |
| 3,308,887 | 3/1967 | Nutter | 166/150 |
| 3,319,718 | 5/1967 | Graff | 166/150 |
| 3,356,137 | 12/1967 | Raugust | 166/3 |
| 3,385,364 | 5/1968 | Whitten | 166/100 |
| 3,417,827 | 12/1968 | Smith et al. | 175/4.52 |
| 3,677,080 | 7/1972 | Hallmark | 166/100 X |
| 3,780,575 | 12/1973 | Urbanosky | 73/152 |
| 3,782,191 | 1/1974 | Whitten | 73/155 |
| 3,811,321 | 5/1974 | Urbanosky | 73/155 |
| 3,813,936 | 6/1974 | Urbanosky et al. | 73/155 |
| 3,858,445 | 1/1975 | Urbanosky | 73/155 |
| 3,859,850 | 1/1975 | Whitten et al. | 73/155 |
| 3,864,970 | 2/1975 | Bell | 73/155 |
| 3,924,463 | 12/1975 | Urbanosky | 73/155 |
| 3,934,468 | 1/1976 | Brieger | 73/155 |
| 3,952,588 | 4/1976 | Whitten | 73/155 |
| 4,063,593 | 12/1977 | Jessup | 43/12 |
| 4,434,653 | 3/1984 | Montgomery | 166/100 X |
| 4,507,957 | 4/1985 | Montgomery et al. | 73/151 |
| 4,513,612 | 4/1985 | Shalek | 73/155 |
| 4,860,581 | 8/1989 | Zimmerman et al. | 73/155 |
| 4,962,665 | 10/1990 | Savage et al. | 73/155 |
| 5,303,775 | 4/1994 | Michaels et al. | 166/264 |
| 5,473,939 | 12/1995 | Leder et al. | 73/155 |

APPARATUS AND METHOD FOR RETRIEVING FORMATION FLUID SAMPLES UTILIZING DIFFERENTIAL PRESSURE MEASUREMENTS

BACKGROUND OF THE INVENTION

1. Field of the Invention

This invention relates generally to formation fluid testing and collection apparatus and more particularly to a closed-loop system for in situ determining the type and condition of formation fluids in a wellbore and for collecting downhole formation fluid samples under the original formation conditions.

2. Description of the Related Art

In the oil and gas industry, wireline formation testing tools have been used for monitoring formation pressures, obtaining formation fluid samples and for predicting reservoir performance. Such formation testing tools typically contain an elongated body having an inflatable packer that is sealingly urged against the zone of interest in the wellbore to collect formation fluid samples in storage chambers placed in the tool.

Various types of drilling fluids are used to facilitate the drilling process and to maintain a desired hydrostatic pressure in the wellbore. These drilling fluids penetrate into or invade the formations for varying radial depths (referred to generally as the invaded zone) depending upon the type the formation and drilling fluid used. Any initial fluid collected by the formation testing tools must first be analyzed to determine when the formation fluid being withdrawn is substantially free of mud filtrates and, thus, to collect only the uncontaminated fluid. Additionally, it is desirable to collect the formation fluids for further analysis in the same condition they exist in the formation. This typically requires that the fluid drawdown pressure be maintained above the bubble point of the fluids. The formation testing tools have utilized various sensors and in situ techniques to determine when the formation fluids being withdrawn are substantially free of mud filtrates and to maintain the drawdown pressure above the bubble point so as to collect clean fluids under the original formation conditions.

Resistivity measurements, downhole pressure and temperature measurements, and optical analysis of the formation fluids have been used to identify the type of formation fluid, i.e., to differentiate between oil, water and gas present in the formation fluid and to determine the bubble point pressure of the fluids. The information obtained from one or more pressure sensors and temperature sensors, resistivity measurements and optical analysis is utilized to control the drawdown rate so as to maintain the drawdown pressure above the bubble point and to determine when to collect the fluid samples downhole.

One prior art tool contains a resistivity measuring device and a temperature sensor as part of a probe assembly to monitor the characteristics of the formation fluid. An additional module containing optical fluid analyzer utilizes near-infrared spectroscopy absorption and reflection to differentiate between oil, water and gas. The fluid from the formation is discharged into the wellbore until the fluid flowing through the flow line is determined to be substantially free from contaminants. The fluid drawrate from the formation is controlled to maintain the drawdown pressure remains above the bubble point.

The interpretation of the flow line resistivity is difficult and often inaccurate. Interpretation of the resistivity must take fluid dynamics into consideration. The resistivity measured is that of the continuous phase of the fluid in the flow line. A water/hydrocarbon mixture with the water as the continuous phase has a low resistivity that increases due to tortuosity as the percentage of hydrocarbon increases. A water-hydrocarbon mixture with hydrocarbon as the continuous phase can has a high resistivity even if the water volume is large. Flow of alternating slugs of hydrocarbon and water produces noisy resistivity recording. This effect is more evident when gas is present.

The optical analyzer provides more accurate results, but is quite expensive and requires the use of sophisticated electronics downhole, which must operate at very high temperatures.

Thus, a need exists to provide a formation fluid retrieval and collection system that is relatively simple, less expensive than the current state-of-the-art systems and relatively accurate in differentiating between the various types of fluid conditions to ensure that substantially uncontaminated formation fluid samples are collected and that the drawdown pressure is maintained above the bubble point of the formation fluid during the fluid collection process.

The present invention addresses the above-noted deficiencies and provides a relatively simple closed loop system for collecting one or more formation fluid samples under original formation conditions.

SUMMARY OF THE INVENTION

This invention provides a closed-loop system for withdrawing a formation fluid from a zone of interest in a wellbore, in situ determination of the type (gas, oil, water, etc,) of the formation fluid being withdrawn, determining the bubble point pressure of the fluid, and for selectively collecting fluid samples above the bubble point pressure of the fluid that are substantially free from any mud filtrates. The closed loop system of the present invention contains an elongated member which has at least one probe that is adapted to be sealingly placed against the wellbore formation. A pump coupled to the probe remotely controls the flow of a fluid from the wellbore formation into a flow line in the elongated member. A pressure sensor provides downhole hydrostatic pressure and differential pressure sensor provides difference in pressure across two fixed points across the flow line. A temperature sensor and resistivity device are utilized in a conventional manner to respectively provide downhole fluid temperature and the resistivity of the formation fluid. The system determines the density of the formation fluid in the flow line from the differential pressure and in response thereto controls the fluid flow into the flow line to selectively collect the formation fluid samples that are substantially free from any mud filtrates while maintaining the fluid pressure above the bubble point pressure of the fluid.

This invention provides a method for retrieving and collecting formation fluids from a zone of interest in a wellbore at the original formation conditions. The method of the invention contains the steps of: (a) sealingly placing a probe against the zone of interest in the wellbore for receiving the formation fluid; (b) controllably allowing the fluid to pass from the probe into a flow line; (c) determining the pressure differential between two fixed points in the flow line; (d) determining the density of the fluid from the differential pressure; (e) controlling the flow of the fluid into the flow line based on the fluid density so as to maintain the fluid pressure in the flow line above the bubble point pressure of the fluid; and (f) collecting a sample of the fluid from the flow line into a downhole storage chamber above the bubble point pressure of the fluid.

Examples of the more important features of the invention thus have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

Figure 1:
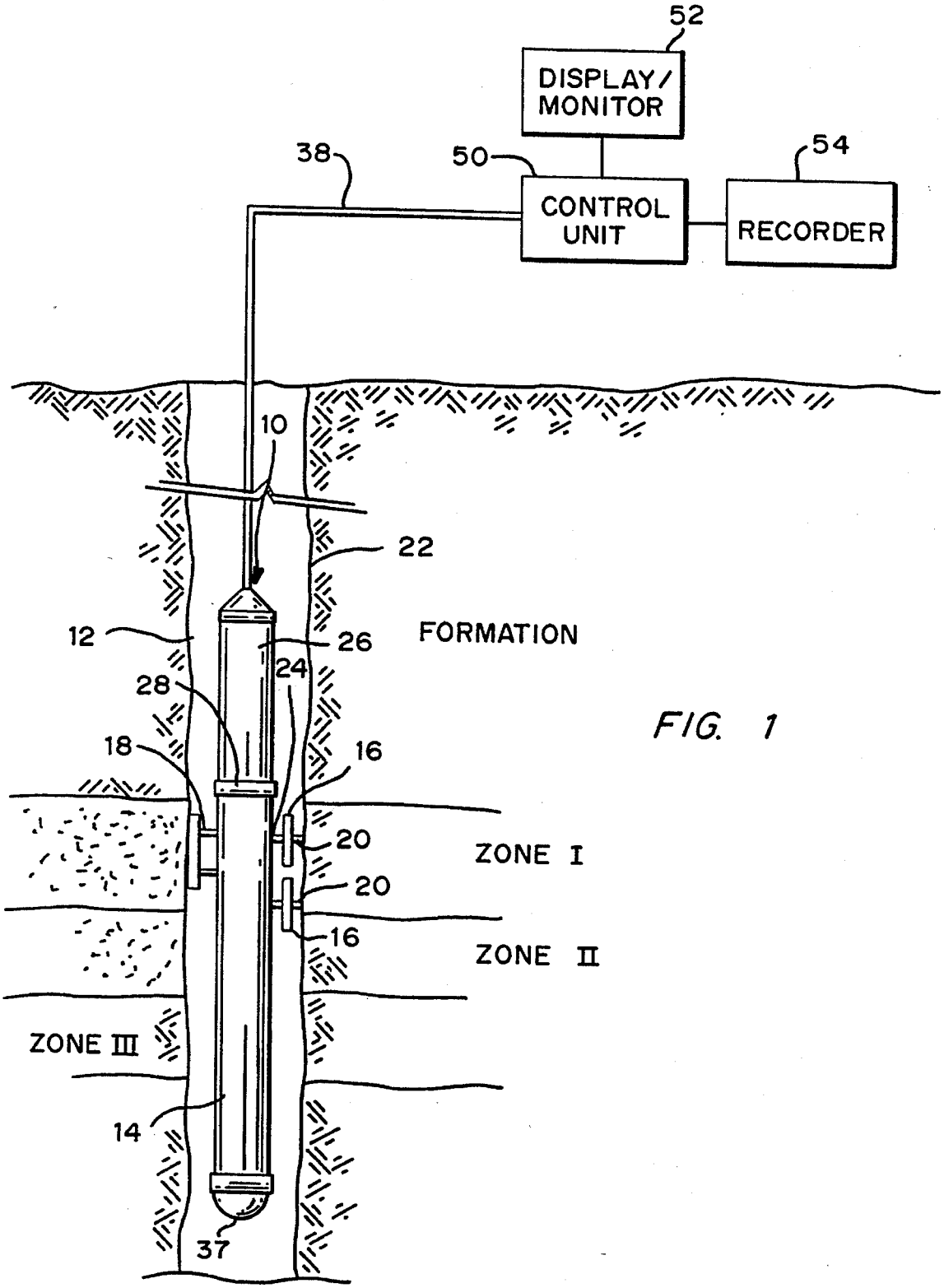
FIG. 1 shows a schematic view of a closed loop system for in situ determining the type and condition of the formation fluids in a wellbore and for collecting the formation fluids under original formation fluid conditions according to the present invention, wherein a formation evaluation tool of the present invention is placed at a predetermined depth inside a wellbore.

FIG. 1 shows a formation evaluation and testing apparatus (tool) 10 of the present invention placed in a wellbore 12 according to the normal operation of the tool. The tool 10 contains a lower elongated section 14 for housing substantially all mechanical operating components of the tool and an upper elongated section 26 coupled in series with the lower section 14 for housing therein downhole electronic circuits and a telemetry for providing two-way data communication between the tool 10 and a surface control unit 50.

The lower elongated section 14 contains one or more inflatable packers 16, each packer being adapted to be sealingly urged against the wellbore formation wall 22. In one embodiment, the pad 16 may be urged against the formation 22 by urging a secondary pad 18 placed opposite the pad 16 against the wellbore interior. Hydraulic means preferably are utilized to inflate the pads 16 to seal the probe in the formation. Any other suitable means may also be used for the purposes of this invention. Each packer 16 contains a probe 20 radially extending away from the tool body and adapted to penetrate into the formation when the pad 16 is urged against the formation wall 22. When the pad 16 is urged against the formation 22, the formation fluid enters the probe through an open inlet port. As shown in FIG. 1, the fluid from the zone I will enter the probe 20, when the pad 16 is urged against the formation. The fluid from the probe 20 enters the lower elongated section via a fluid line 24, where it is analyzed and collected. The lower elongated section 14 also contains a number of sensors and devices that are utilized to determine the type and condition of the fluids being collected and to collect the fluid samples under the conditions under which such fluids are present in the formation, as is more fully explained later in reference to FIG. 2.

The lower elongated section 14 terminates at a removable sealed nose 37, which is removed to connect the tool 10 to other downhole tools. The two elongated sections 14 and 26 are coupled to each other by means of a coupler 28 having feed-through connectors therein that sealingly interconnect electrical conductors placed in the upper and lower elongated sections to provide desired electrical connections between the two sections.

The upper section 26 preferably contains all of the downhole circuits for receiving and processing signals from the various sensors contained in the tool 10 and for controlling the various devices to collect desired formation fluid samples and a downhole duplex telemetry for providing two way communication between the control unit 50 and the tool 10.

The top end 25 of the tool 10 is coupled to an armored wireline cable 38 having a plurality of conductors for providing power to the various components in the tool 10 and for providing two-way electrical and data transmission between the tool 10 and the control unit ,50, which is usually placed uphole in a suitable truck or a cabin (not shown). The control unit 50 contains a computer for controlling the operation of the tool 10 and for online and offline processing of the data received from the tool 10. The control unit 50 is coupled to a variety of peripherals, such as a recorder 54 for recording data and a display/monitor 52 for displaying desired information during operation. The use of the control unit 50, display/monitor 52 and recorder 54 is known in the art of well logging and is, thus, not explained in greater detail herein.

To operate the system of the present invention, the tool 10 is lowered into the wellbore 12 by means of the wireline 38 to a desired depth. The pad 16 is urged against the wellbore wall 22 at the zone of interest, such as zone I. The tool 10 is then activated by the control unit 50 according to programmed instruction and/or by an operator, thereby causing the formation fluid to flow from the zone I into the probe 20. The control unit 50 continuously controls the operation of the tool 10, processes data received from the tool and provides continuous information about the tool operation and the results obtained therefrom to the operator, as is more fully explained below in reference to FIG. 2.

Figure 2:
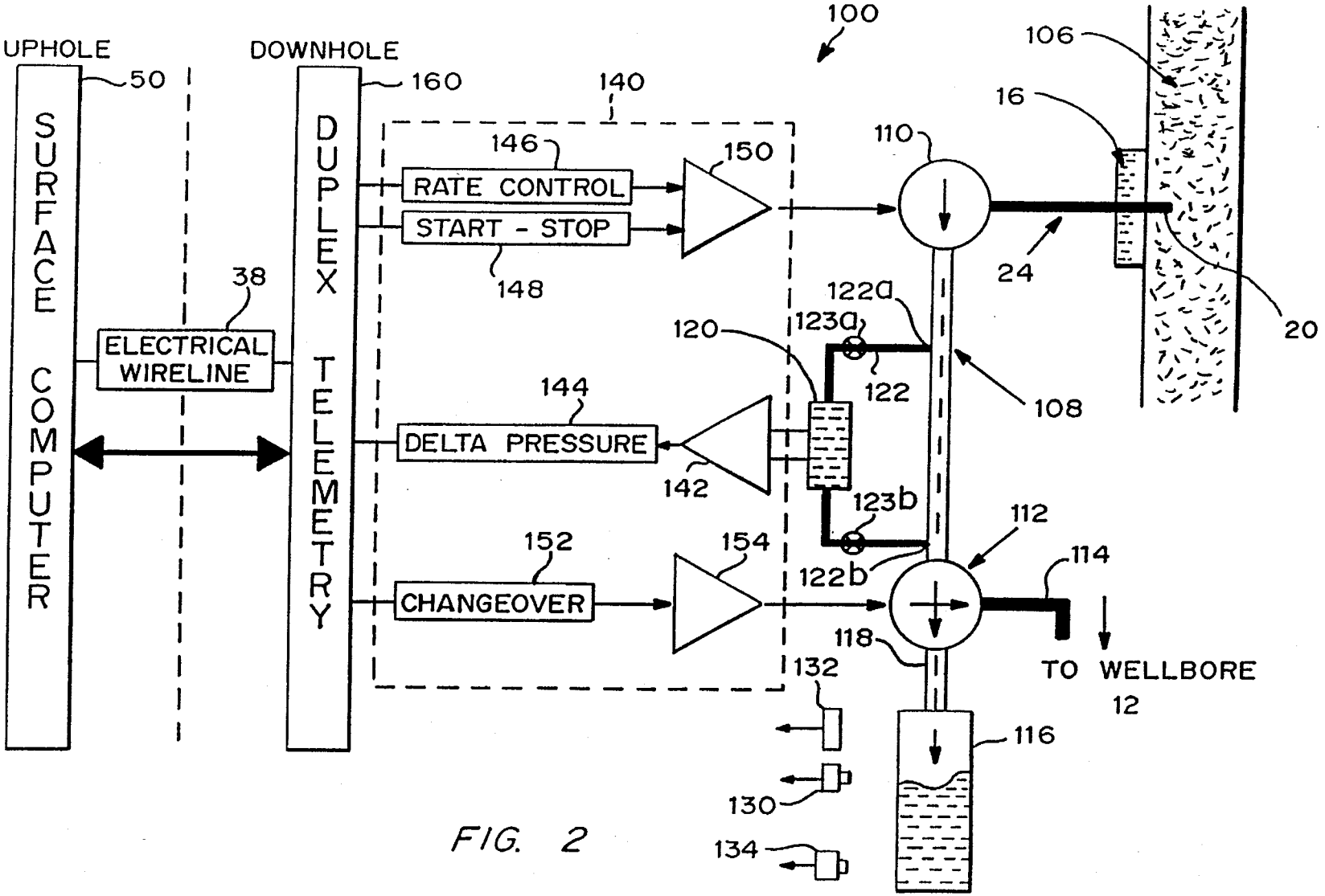
FIG. 2 shows a functional block diagram of the closed loop system of FIG. 1 for withdrawing and retrieving formation fluid samples.

FIG. 2 is a functional block diagram depicting the major components of the system 100 for selectively retrieving and collecting formation fluids from zones of interest in a wellbore and testing of certain wellbore conditions associated therewith according to the present invention. The system 100 is shown to contain a probe 20 placed in a packer 16 that is urging against a desired zone of interest 106 in the wellbore 12. The probe 20 is coupled in fluid communication with a flow line 108 via a remotely controllable flush pump 110 which controls the flow rate of fluids from the formation 106 to the flow line 108. The bottom end of the flow line 108 is coupled to a remotely controllable multiport valve 112, which may be commanded by the control unit 50 to direct flow of the fluid from the flow line 108 into the wellbore 12 via a line 114 or to one of the storage chambers, such as chamber 116, via an associated fluid line 118.

A differential pressure sensor 120 is coupled to a hydraulic buffer line 122 placed parallel to and in fluid communication with the flow line 108 for providing signals representative of the difference in pressure between two fixed points across the flow line 108. The differential pressure sensor preferably is solid-state-type differential pressure sensor. Such sensors are relatively accurate and sensitive to small changes in pressure variations in the flow line. The hydraulic buffer line 122 connects the flow line 108 at two points 122*a* and 122*b* that are at least two feet apart to provide discernable pressure difference between these points. The hydraulic buffer line 122 preferably is filled with a viscous fluid of known specific gravity, such as silicone, to prevent invasion of the formation fluid into the hydraulic buffer line 122. Two valves 123*a* and 123*b* respectively coupled above and below the differential pressure sensor 120 in the buffer line 122 may automatically be closed whenever the pressure difference across the differential pressure 120 exceeds a predetermined limit, typically one (1) psi, so as to protect the differential pressure sensor from damage. In one position, the valves 123*a* and 123*b* may be operated to cause the differential pressure sensor 120 to measure the pressure difference over the fixed height in the flow line, i.e., the differential pressure of the formation fluid in the flow line 108 and in a second position over the fixed height of the mud column in the wellbore 12, i.e., the differential pressure of the mud column in the wellbore.

The mechanical and hydraulic components of the system described thus far preferably are arranged in the lower elongated section 14 (see FIG. 1). If more than one probe 20 is used in the system 100, such additional probes may be coupled to the flow line 108 via a separate flush pump associated with each such probe. In practice, at least two probes are used for collecting fluid samples and as back-up units. Also, several storage chambers of different storage capacities are mounted within the lower elongated section 14. Fluid flow from the flow line 108 into such storage chambers may be controlled by multi-port valves, such as valves 112, coupled between the flow line 108 and their associated storage chambers.

Still referring to FIG. 2, the system 100 contains a downhole electronic control circuit 140 and two-way data communication means 160, preferably in the form of a duplex telemetry. As noted earlier, the electronic control circuits 140 and the telemetry 160 preferably are placed within the upper elongated section 26. The downhole control circuit 140 contains a pre-amplifier 142 coupled between the differential pressure sensor 120 and a delta pressure circuit 144. The output signals from the differential pressure sensor 120 are amplified by the pre-amplifier 142 and fed to the delta pressure circuit 144, which processes the received signals and feeds the processed signals in digital data form to the duplex telemetry 160.

A rate-control circuit 146 and start-stop circuit 148 are coupled to the flush motor 110 via an amplifier 150. The rate control circuit 146 selectively controls the flow rate through the flush pump 110 in response to command signals received from the control unit 50. The start-stop circuit 148 causes the flush pump 110 to start or completely shut down as commanded by the control unit 50. The rate control circuit 146 and the start-stop circuit 148 also provide pump status signals to the control unit 50 via the duplex telemetry 160. Such status include information that enables the control unit 50 to determine the rate at which the flush pump 110 is pumping fluid and whether the pump is fully closed. A changeover circuit 152 coupled to the flow control valve 112 via an amplifier 154 controls the fluid flow through the valve 112 upon command signals received from the control unit 50. The changeover circuit 152 causes the flow control valve 112 to completely close the fluid flow through the flow line 108 or divert the fluid from the flow line 108 to either the wellbore 12 or the chamber 116.

The rate control circuit 146, start-stop circuit 148, delta pressure circuit 144 and the changeover circuit 152 communicate with the control unit 50 via the duplex telemetry 160, which has an uplink portion and a downlink portion. These and other downhole circuits provide signals to the duplex telemetry 160 for transmission to the control unit 50. The duplex telemetry 160 receives command signals from the control unit 50 and provides such signals to the appropriate downhole circuits. In this manner the duplex telemetry provides two-way data communication between the tool 10 and the control unit 50.

The system 100 also contains a pressure sensor 130 and associated circuitry for determining the wellbore pressure and a temperature sensor 132 and associated circuitry for determining the wellbore temperature. A conventional resistivity device 134 may be provided for determining the resistivity of the formation fluid for qualitative determination of the type fluid in the formation, i.e., hydrocarbons, fresh water and salt water. The pressure sensor 130, temperature sensor 132 and the resistivity device 134 may be placed in the tool 10 at any convenient location. The arrows 131 are shown to indicate that the signals from such devices are passed to their associated downhole circuits, which continuously transmit relevant information uphole to the control unit 50 via the duplex telemetry 160.

To operate the system 100, the tool 10 is lowered into the wellbore 12 via the wireline cable 38 at a predetermined speed. During descent of the tool 10 in the wellbore, the ports 123*a* and 123*b* are positioned for the differential pressure sensor to provide signals corresponding to the difference in pressure of the mud column across the buffer line 122. The control unit receives the processed differential pressure signals from the delta pressure circuit, computes therefrom the mud density and provides a log thereof as a function of the depth. Similarly, the control circuit receives signals from the pressure sensor 130 and temperature sensor 132 and provides a pressure and temperature logs as a function of the wellbore depth.

The initial fluid drawn from the formation 106 typically contains mud filtrates which have invaded into the formation 106. It is important that the formation fluids collected downhole be uncontaminated (clean fluid) and in the same physical conditions in which such fluids are present in the formation. For example, the gas and oil contents of the fluid should be maintained in the manner present in the formation during the collection process. This requires determining when the fluid flowing through the flow line is substantially free of mud filtrates and collecting the fluid above the bubble point pressure of the fluid. As noted earlier, the prior art tools utilize resistivity measurements and optical means to continuously determine the downhole conditions of the fluid during the collection process and to control the flow rate to maintain the fluid pressure above the bubble point. Such apparatus and method are complex and either very expensive or not reliable.

To analyze the formation fluid type and the downhole conditions associated therewith and to collect the formation fluid samples, the tool 10 is lowered to desired depth. The control unit 50 initiates a command signal (data sequence), which is sent to the flush pump 110 via the duplex telemetry 160 and the start-stop circuit 148 to provide hydraulic power to initiate the setting of the packer 16 against the formation 106. Once the packer 20 has been set and the hydraulic seal between the packer 16 and the formation 106 has been achieved, the control unit 50 sends a second command signal to switch the flush pump 110 from the hydraulic pressure provider to the pump-out mode, causing the formation fluid to flow from the formation 106 into the flow line 108.

Initially, the system sets the multi-port valve to discharge the fluid from the flow line 108 into the wellbore 12. The delta pressure circuit 144 transmits the differential pressure signals uphole to the control unit 50 via the upline section of the duplex telemetry 160. During the flushing of the fluid into the wellbore 12, the density of the fluid in the flow line is continually monitored for any drop in the differential pressure along the fixed length of the hydraulic buffers 122. The delta pressure circuit 144 provides fluid identification by gradient measurement (delta pressure over the column length). This function is corrected for any wellbore deviation by any suitable method known in the art. The computer associated with the control unit 50 converts the differential pressure information the density (grams/cc) and determines the fluid type actually flowing through the flow line 108 by utilizing programmed instructions stored in the control unit 50. Known correlation between the types of formation fluid and their densities is utilized in determining the fluid type. The control unit also continuously displays the fluid density information on the display/monitor 52 for observation. The control unit, thus, utilizing the fluid density determines the type of fluid and when the fluid in the flow line 108 is substantially free of mud filtrates. Additionally, the control circuit continuously measures, record and displays the fluid pressure and temperature.

The control unit 50 is adapted to provide a closed-loop system which enables the computer or the operator through a manual override to continuously control the operation of the flush pump 110 to control the flow rate through the flow line 108 at a rate that will maintain the drawdown pressure above the bubble point. When the operator is satisfied with the quality of the fluid flowing through the flow line 108, a command signal is sent downhole that is interpreted by the changeover circuit 152 and causes the flow control valve 112 to divert the fluid from the flow line 108 to a desired chamber, such as chamber 116. The above described system ensures that the collected fluid samples are suitable for further PVT analysis in a surface laboratory.

When a desired amount of the fluid has been collected in the fluid chamber 116, a new command signal may be sent downhole to select other chambers or to stop the operation of the pump 112 or to reverse the cycle and start another cycle, if necessary.

To determine the bubble point pressure, the formation fluid flow rate into the flow line 108 is slowly increased by controlling the flush-pump 110 while continuously monitoring the fluid density and the fluid temperature. As the fluid rate is increased, the gas in fluid, if present, will expand into a gaseous state from its normal liquid state i which it is present in the formation, which will be observed as a sudden decrease in the differential pressure and, thus, density. The pressure at which the density drops is the bubble point pressure of the fluid at the noted temperature. To ensure the accuracy of the results, the flow rate increased until the density suddenly rises to the initial value of the clean fluid and the corresponding fluid pressure and temperature recorded. The procedure may be repeated if necessary to accurately determine the bubble point pressure. The system of the present invention also provides a continuous resistivity measurement of the formation, which is used to distinguish between the presence of hydrocarbons and water in the formation.

Additionally, the differential pressure sensor 120 provides information about the wellbore hydrostatic pressure as the tool is being lowered into the wellbore, which is used to continuously log the wellbore pressure corresponding to the wellbore tool depth. Prior art tools typically log the hydrostatic wellbore pressure by utilizing strain gauges. The use of the differential pressure provides more accurate pressure information compared to strain gauges, thereby improving the quality of the pressure log.

Thus, the system of the present invention includes a downhole tool having a differential pressure sensor across a flow line for continually determining the pressure differential across a fixed column of the formation fluid while it is being drawn. A control unit determines the density of the formation fluid from the differential. The system utilizing the density determines when the fluid in the flow line is substantially free from mud filtrates, the bubble point pressure and controls the flow through the flow line in a manner that the fluid is collected above the bubble point pressure of the fluid. The same differential pressure sensor may be used to provide the pressure gradient log, information about the fluid condition during fluid drawdown from the formation, ensure that the formation fluid collected is substantially free of mud filtrates, ensure that the drawdown pressure is maintained above the bubble point and for in situ measurement of the bubble point pressure.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A system for retrieving a formation fluid from a formation, comprising:

(a) a probe adapted for placement against the formation for receiving fluid from the formation;

(b) a pump for controlling flow of the fluid ("flow rate") from the probe into a flow line;

(c) a differential pressure sensor coupled across the flow line for providing a signal representative of the difference in pressure between two fixed points in the flow line; and (d) control circuit coupled to the pump and the differential pressure sensor for controlling the pump to control the flow rate of the fluid as a function of the differential pressure so as to maintain the pressure in the flow line above a predetermined pressure.

2. The apparatus as specified in claim 1, wherein the control circuit contains a first circuit for processing the differential pressure signals and a second circuit for controlling the operation of the pump.

3. A system for retrieving a formation fluid from a formation, comprising:

(a) a probe adapted for placement against the formation for receiving the formation fluid;

(b) a pump for controlling rate of flow of the formation fluid ("formation fluid flow rate") from the probe into a flow line;

(c) a differential pressure sensor coupled across the flow line for providing a signal representative of the difference in pressure between two fixed points in the flow line;

(d) a valve coupled to the flow line for selectively directing the formation fluid discharge from the flow line into a chamber or the wellbore; and (e) a control circuit coupled to the pump, valve and the differential pressure sensor, said control circuit controlling the formation fluid flow rate into the flow line as a function of the differential pressure so as to maintain pressure in the flow line above a predetermined pressure, said control circuit further controlling the valve to collect the formation fluid in the chamber.

4. The apparatus as specified in claim 3 further having a telemetry coupled to the control circuit for transmitting data to and from the control circuit.

5. The apparatus as specified in claim 4 further having a surface control unit coupled to the telemetry by a wireline, said surface control unit receiving data from the downhole control circuit corresponding to the differential pressure sensor signals and in response thereto transmitting command signals to the control circuit for controlling the operation of the pump.

6. The apparatus as specified in claim 5 wherein the surface control unit further transmits signals to the control circuit to control the operation of the valve.

7. A system for retrieving and collecting a formation fluid from a zone of interest in a wellbore, comprising:

(a) a probe adapted for placement against the zone of interest in the wellbore for receiving the formation fluid;

(b) a pump for controlling the flow rate of the formation fluid from the probe into a flow line;

(c) a differential pressure sensor coupled across the flow line for providing a signal representative of the difference in pressure between two fixed points in the flow line; and (d) a control unit for determining density of the formation fluid from the differential pressure signals and in response thereto controlling the flow of the formation fluid so as to maintain the pressure in the flow line above the bubble point pressure of the fluid.

8. The apparatus as specified in claim 7, wherein the surface control unit contains a computer and a display.

9. A system for retrieving and collecting a formation fluid from a zone of interest in a wellbore, comprising:

(a) a probe adapted for placement against the zone of interest in the wellbore for receiving the formation fluid;

(b) a pump for controlling flow of the formation fluid ("formation fluid flow rate") from the probe into a flow line;

(c) a differential pressure sensor coupled across the flow line for providing a signal representative of the difference in pressure between two fixed points in the flow line;

(d) a control circuit coupled to the pump and the differential pressure sensor for processing the differential pressure signal and for controlling the operation of the pump in response to command signals; and (e) a control unit, said control unit receiving the differential pressure signals, computing density of the fluid in the flow line and determining from the density when the fluid flowing in the flow line is substantially free of mud filtrates, said control unit further causing the flow rate to change as a function of the density in a manner which ensures that the pressure in the flow line remains above the bubble point of the fluid in the flow line.

10. A system for retrieving and collecting a formation fluid from a zone of interest in a wellbore, comprising:

(a) a downhole tool adapted to be conveyed in the wellbore having (i) a probe adapted for placement against the zone of interest for receiving the formation fluid;

(ii) a pump for controlling flow of the formation fluid ("flow rate") from the probe into a flow line;

(iii) a differential pressure sensor coupled across the flow line for providing a signal representative of the difference in pressure between two fixed points in the flow line;

(iv) a control valve for controlling the flow rate of the formation fluid from the flow line into a chamber;

(v) a resistivity device for providing information about resistivity of the fluid flowing through the flow line; and (b) a surface control unit for causing the flow rate to change as a function of the density in a manner which ensures that the pressure in the flow line remains above the bubble point of the fluid, said control unit further determining from the resistivity of the formation fluid when the fluid in the flow line is substantially free of mud filtrates and causing the control valve to discharge the fluid that is substantially free of mud filtrates into a chamber.

11. A formation testing and fluid collection apparatus, comprising:

(a) a probe adapted to be sealingly placed against a wellbore formation for receiving the fluid from the formation;

(b) a pump coupled to the probe for controlling the flow of the fluid from the probe into a flow line;

(c) a buffer line placed coupled across flow line between two points that are at least two feet apart;

(d) a pair of valves placed in the buffer line at least two feet apart, each said valve adapted to selectively cause the buffer line to be in fluid communication with the flow line and wellbore fluid;

(e) a differential pressure sensor placed in the buffer line for providing difference in the pressure between two selected points;

(f) a first circuit for determining the pressure gradient from the differential pressure signals;

(g) a second circuit for controlling the flow rate through the pump; and (h) a control unit, said control unit receiving signals from the first circuit and in response thereto generating control signal for the second circuit for controlling the flow of the fluid through the pump in a manner that will ensure that any fluid flowing into the flow line remains below the bubble point of any liquid gas contained in the fluid.

12. The system as specified in claim 11 further having a duplex telemetry coupled between the control unit and the first and second circuits for providing data transmission between the control unit and the first and second circuits.

13. The system as specified in claim 11 wherein the control unit receives data from the first circuit corresponding to the differential pressure sensor signals and in response thereto transmits command signals to the second circuit for controlling the operation of the pump.

14. The apparatus as specified in claim 11 further having a pressure sensor for providing signals representative of the pressure of the fluid in the flow line.

15. The apparatus as specified in claim 11 further having a temperature sensor for providing signals representative of the temperature of the fluid in the flow line.

16. The apparatus as specified in claim 11 further having a resistivity device for providing signals for determining the resistivity of the formation fluid.

17. A method for retrieving a formation fluid from a zone of interest in a wellbore, said method comprising the steps of:

(a) withdrawing the formation fluid from the zone of interest into a flow line;

(b) determining the pressure differential between two fixed points across the flow line;

(c) determining the density of the fluid from the differential pressure; and (d) controlling the flow of the fluid into the flow line based on the fluid density determination in a manner that ensures that the pressure in the flow line remains above the bubble point of the fluid.

18. A method for retrieving and collecting a formation fluid from a zone of interest in a wellbore, said method comprising the steps of:

(a) discharging the formation fluid from the zone of interest into a flow line;

(b) determining the pressure differential between two fixed points across the flow line;

(c) determining the density of the fluid from the differential pressure;

(d) controlling the flow of the fluid into the flow line based on the fluid density determination in a manner that ensures that the flow line pressure remains above the bubble point of the fluid; and (e) collecting the fluid from the flow line in a chamber above the bubble point pressure.

19. A method for retrieving and collecting formation fluid that is substantially free of mud filtrates from a wellbore formation, said method comprising the steps of:

(a) discharging the formation fluid into a flow line having a pump at one end that is adapted to control the fluid flow rate into the flow line and a two-way valve that is adapted in a first position to discharge the fluid from the flow line into the well bore in a second position into a collection chamber;

(b) determining the pressure of the fluid flowing into the flow line and the differential pressure of the fluid in the flow line between two fixed points across the flow line;

(c) determining density of the fluid from the differential pressure;

(d) determining resistivity of the fluid flowing into the flow line;

(e) determining from the density and the pressure of the fluid in the flow line the bubble point of the fluid;

(f) determining from the resistivity when the fluid flowing through the flow line is substantially free of mud filtrates;

(g) controlling the flow rate through the flow line by controlling the pump so as to maintain the flow line pressure above the bubble point pressure; collecting the fluid from the flow line in a chamber above the bubble point pressure; and (h) collecting the fluid in the collection chamber when the fluid flowing through the flow line is substantially free of mud filtrates and the fluid pressure is above the bubble point pressure.

20. A method for determining bubble point pressure of a formation fluid in a wellbore, comprising the steps of:

(a) discharging the formation fluid from a zone of interest into a flow line;

(b) determining the pressure of the fluid in the flow line and pressure differential between two fixed points across the flow line;

(c) determining the density of the formation fluid from the differential pressure;

(d) changing the fluid flow rate into the flow line; and (e) repeating steps (b)–(d) a desired number of times, recording the pressure in the flow line and the differential pressure corresponding to each flow rate and determining therefrom the bubble point pressure of the fluid.

* * * * *

UNITED STATES PATENT AND TRADEMARK OFFICE

CERTIFICATE OF CORRECTION

PATENT NO. : 5,622,223

DATED : April 22, 1997

INVENTOR(S) : Rafael B. Vasquez

It is certified that error appears in the above-indentified patent and that said Letters Patent is hereby corrected as shown below:

Claim 19, line 35, after "bore" add --and--.

Signed and Sealed this

Twelfth Day of August, 1997

Bruce Lehman

*Attest:*

BRUCE LEHMAN

*Attesting Officer*

*Commissioner of Patents and Trademarks*